United States Patent [19]

Kaminstein

[11] Patent Number: 4,457,964

[45] Date of Patent: Jul. 3, 1984

[54] PLACE MAT

[76] Inventor: Bernard Kaminstein, 29 Third Ave., New York, N.Y. 10003

[21] Appl. No.: 383,022

[22] Filed: May 28, 1982

[51] Int. Cl.[3] ..... B65D 3/02

[52] U.S. Cl. ..... 428/43; 428/81; 428/131; 428/132; 428/133; 428/134; 428/135; 428/136; 428/137; 428/147; 428/148; 428/153; 428/192; 428/219; 428/340; 428/341; 428/342; 428/336; 428/513; 428/514; 428/485; 428/486; D6/616

[58] Field of Search ..... 428/906, 43, 153, 192, 428/131–137, 81, 204, 147, 148, 219, 340–342, 336, 513, 514, 485, 486; D6/271, 273

[56] References Cited

U.S. PATENT DOCUMENTS

| | | | |
|---|---|---|---|
| D. 166,234 | 3/1952 | Wood et al. | D6/271 |
| D. 266,616 | 10/1982 | Appleman | D6/271 |
| 422,866 | 3/1890 | Wheeler | 428/43 |
| 1,442,056 | 1/1923 | Edmonds | 428/43 |
| 4,214,024 | 7/1980 | Jacobson | 428/43 |
| 4,238,541 | 12/1980 | Burton | 428/906 |
| 4,326,006 | 4/1982 | Kaminstein | 428/204 |

*Primary Examiner*—George F. Lesmes
*Assistant Examiner*—E. Rollins Buffalow
*Attorney, Agent, or Firm*—Stephen E. Feldman

[57] ABSTRACT

A non-slip place mat is disclosed which comprises a web such as a paper sheet, and a composition coating comprising a blend of water, a water-soluble salt, a wax and a polymeric material, which both coats and impregnates the web, e.g. the paper sheet, whereby said sheet is rendered substantially hydrophobic and it and items placed on it are rendered substantially slip-resistant when resting on a tray or table which may be subject to sudden movement. The non-slip place mat is particularly useful for airline serving trays. The present place mat is characterized by the provision of a generally rectangular planar flexible web, which is indented along two opposed edges. The web is multi-layered, i.e. coated, and the four corners of the web are rounded off, so that each corner is defined by a curved periphery. A plurality of place mats in a roll and arrayed in tandem, i.e. juxtaposed seriatim, is also contemplated, each two adjacent mats being detachably attached to each other by a weakened zone comprising a rectilinear array of spaced-apart and typically circular perforations, each array of perforations extending transverse to the longitudinal axis of the rolled-up line of place mats, i.e. parallel to the central longitudinal axis of the cylindrical roll.

21 Claims, 3 Drawing Figures

PLACE MAT

BACKGROUND OF THE INVENTION

1. Field of the Invention

This invention relates to place mats. More specifically, this invention relates to a composition-coated, non-slip, paper place mat, as described in my U.S. Pat. No. 4,326,006.

2. Discussion of the Prior Art

It was known in the prior art to coat cellulose or paper sheets with different substances, so as to impart various desired characteristics, such as in U.S. Pat. No. 1,971,337 to H. B. Collins, granted Aug. 28, 1934, which relates to a coaster pad waterproofed by a layer of asphaltum or rubber cement.

The prior art, specifically U.S. Pat. No. 2,444,443 to C. F. Hesselroth, granted July 6, 1948, also discloses a wrapping tape or sheet which comprises a wax-coated web of fibers in combination with a non-porous hydrophobic organic film such as cellulose acetate.

U.S. Pat. No. 2,173,129 relates to a coated and impregnated paper which may be used for covering boxes and containers or for use as table covers and the like. This reference incorporates semi-drying oils, drying oils and resins in the presence of a selected percentage of water being based on the paper weight. Paint, lacquer, varnish and/or resin is also applied to the paper to further impart waterproof characteristics.

U.S. Pat. No. 3,607,348, granted Sept. 21, 1971, to Wary et al, discloses a cellulose fiber or tissue paper structure for use in a printing process which is coated twice on one side with hydrophobic and hydrophilic compositions. This reference discloses the use of waxes in combination with polymers and/or resins as a discontinuous coating over one side of the tissue paper whereby the porosity of the paper is not altered.

In addition, of course, is the well-known household commercial product "wax paper" which basically comprises a wax-impregnated cellulose sheet.

It was also commonly known in the prior art to manufacture place mats out of uncoated or non-impregnated paper. In addition, it was also commonly known to use urethane-foam-backed plastic films, whereby the foam provided cushioning and prevented slippage of said place mat when the surface upon which it rested moved, and whereby the plastic film provided the hydrophobic surface. Pertinent U.S. Design Patents showing place mat designs include Nos. D-261,067; D-261,066; D-240,962, and D-166,234.

SUMMARY OF THE INVENTION

1. Purposes of the Invention

It is an object of the present invention to provide a non-slip place mat.

It is another object of the present invention to provide a method for making a coating for incorporation into paper or other substrate for making a non-slip place mat.

It is another object of this invention to provide a hydrophobically-coated-paper, non-slip place mat.

It is a further object of this invention to provide a place mat which will render objects placed thereon resistant to slippage when said place mat is resting on a surface and is subjected to movement.

It is an additional object of this invention to provide a printed and coated paper place mat wherein the printing and coating act together to create a water-resistant surface.

It is still another object of this invention to provide a non-slip place mat for use on surfaces subject to sudden movement, such as home dining tables and the food trays of mass transit vehicles, such as airplanes, trains, boats and buses.

The aforesaid as well as other objects and advantages will be made more apparent in reviewing the attached drawings and in reading the following description and the adjoined claims.

2. Brief Description of the Invention

Broadly speaking, one preferred embodiment of the present invention is a composition-coated paper place mat. More specifically, said place mat has a printed surface on one side and a non-printed surface on the other, and a coating composition of the same thickness on both sides of said mat. A roller is used to put on the coating. Typically, the printing is visible through the top of the coating composition of the place mat. The printing ink acts as a hold-out with respect to the coating, and not as much of the coating is absorbed into the paper on the printed matter side, i.e. since not as much of the coating is absorbed, hence more lays on the surface of the mat.

In another aspect, the present place mat comprises:

a. a paper sheet; and b. a composition coating comprising a blend of water, a water-soluble salt, a wax and a polymeric material, wherein the composition coating both coats and impregnates the paper sheet whereby the paper sheet is rendered generally hydrophobic and is slip-resistant to items placed in contact with the sheet.

In a more specific aspect, the place mat of this invention comprises:

a. a printed paper sheet; and b. a composition coating comprising a blend of water, sodium borate, beeswax having a molecular weight up to about 2,000, and a polymeric material having a molecular weight of at least 5,000.

A method for the preparation of the coating composition of the preferred embodiment of this invention generally comprises:

a. heating an amount of water;

b. melting an amount of wax;

c. adding to the heated water of step (a) an amount of water-soluble salt;

d. adding the wax of step (b) to the mixture of step (c); and e. adding the mixture of step (d) to a polymeric material.

The present invention basically entails the provision of a non-slip place mat which comprises a web such as a paper sheet, and a composition coating comprising a blend of water, a water-soluble salt, a wax and a polymeric material, which both coats and impregnates the web, e.g. the paper sheet, whereby said sheet is rendered substantially hydrophobic, and it and items placed on it are rendered substantially slip-resistant when resting on a tray or table which may be subject to sudden movement. The non-slip place mat is particularly useful for airline serving trays. The present place mat is characterized by the provision of a generally rectangular planar flexible web, which is indented along two opposed edges. The web is multi-layered, i.e. coated, and the four corners of the web are rounded off, so that each corner is defined by a curved periphery. A plurality of place mats in a roll and arrayed in tandem, i.e. juxtaposed seriatim, is also contemplated, each two adjacent mats being detachably attached to each other by a weakened zone comprising a rectilinear array of spaced-apart and typically circular perforations, each array of perforations extending transverse to the longitudinal axis of the rolled-up line of place mats, i.e. parallel to the central longitudinal axis of the cylindrical roll, in a generally rectilinear line of perforations.

The present invention thus basically entails the provision of a non-slip place mat article which includes a generally rectangular planar flexible web, the web being indented along two opposed edges, and being multi-layered, the four corners of the web being rounded off, so that each corner is defined by a curved periphery, and the web comprising an outer layer composition coating on both sides, the composition coating comprising a blend of water, a water-soluble salt, a wax, and a polymeric material having a molecular weight greater than the wax.

In a preferred embodiment, the indentations along two opposed edges of the web are semi-circular, the indentations being derived from circular perforations arrayed in a line and between adjacent webs in a roll comprising a plurality of juxtaposed non-slip webs, consisting of place mat articles oriented in tandem in a line.

Typically, the web includes a primary layer of plastic or paper constituting a major part of the thickness of the web. In this embodiment, the primary layer may be composed of a plastic selected from the group consisting of polyvinyl chloride, polyvinyl acetate, polyethylene, and polypropylene; or the primary layer may be composed of a paper selected from the group consisting of kraft paper, cardboard, paperboard, a cellulose fiber sheet, a tissue paper structure, and parchment.

Typically, the polymeric material is one selected from the group consisting of acrylics, natural and synthetic latex, and neoprene; and generally the polymeric material is in a powdered solid form, or the polymeric material is dispersed in solution, e.g. the polymeric material may be dissolved in a solvent solution. The preferred water-soluble salt is sodium borate. The wax is typically comprised of one selected from the group consisting of beeswax and microcrystalline wax, and typically the composition coating on the web is about 1 mil. thick.

In a preferred embodiment, the place mat further comprises printing on the web. The printing generally is on one side of the web, and preferably the composition coating is applied over the printing and non-printing side. The ink for printing may be incorporated into the composition coating, and the web may be dyed during the formation.

It is preferred that the weight ratio of water to wax to water-soluble salt be about 1:0.1 to 0.3:0.01 to 0.05, and the ratio of water, wax and water-soluble salt to polymeric material usually is about 1:1. Typically, the web is comprised of paper with a weight from about 10 to 100 lbs./ream, and the polymeric material generally has a molecular weight of at least about 5,000.

In a preferred embodiment, the present place mat invention also contemplates and includes a generally cylindrical roll of a plurality of juxtaposed non-slip place mat articles oriented in a line, each of the place mats being contiguously attached to adjacent place mats, in tandem, by a weakened zone comprising a rectilinear array of spaced-apart perforations between each two adjacent place mats. Each array of perforations typically extends transverse to the longitudinal axis of the line of place mats. Each place mat comprises a generally rectangular planar flexible web, so that when each place mat is detached in turn from the roll, the detached web is indented along two opposed edges; the web being multi-layered, and the four corners of the web being rounded off, so that each corner is defined by a curved periphery. The web includes an outer layer composition coating on both sides, the composition coating comprising a blend of water, a water-soluble salt, a wax, and a polymeric material having a molecular weight greater than the wax. Usually, each of the perforations in the roll is substantially circular.

The invention accordingly consists in the features of construction, combination of elements, and arrangement of parts which will be exemplified in the article of manufacture hereinafter described, and of which the scope of application is as elucidated supra and as will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
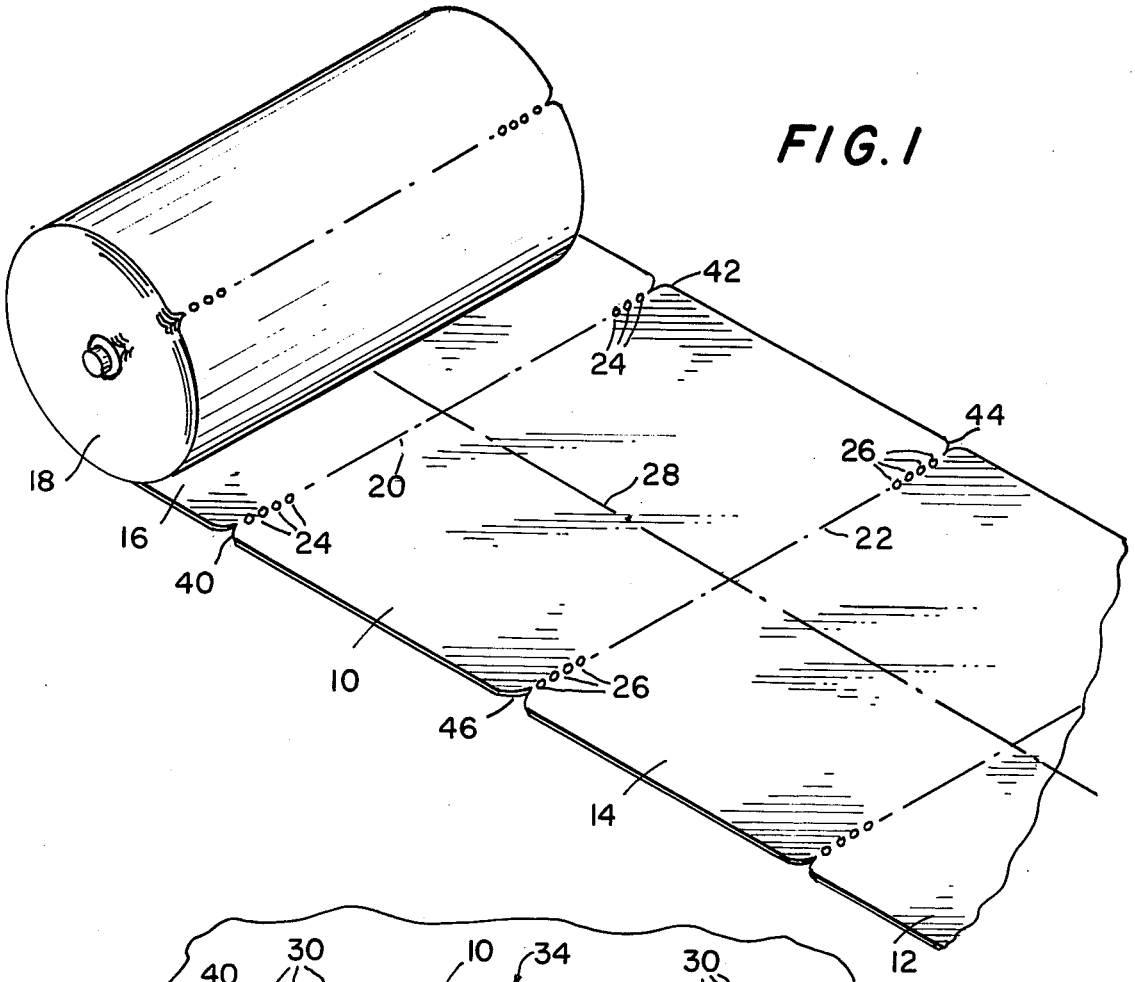
FIG. 1 is a perspective view of a roll of detachably attached non-slip place mats in tandem, the roll being partially unrolled.

Referring now to the Figures, the present non-slip place mat article 10 as formed, i.e. manufactured, is one of a plurality of place mats, such as 12, 14, and 16, which as originally constituted are rolled up in a roll 18. The generally cylindrical roll 18 comprises a plurality of juxtaposed place mat articles oriented in a line. Each of the place mats is contiguously attached to adjacent place mats (FIG. 1), in tandem, by weakened zones such as zones 20, 22, each of which comprises, as shown, a rectilinear array of spaced-apart, generally circular perforations 24 (zone 20) or 26 (zone 22), between each two adjacent place mats 10, 16 or 10, 14. As shown, each rectilinear array 24 or 26 of perforations extends transverse to the longitudinal axis 28 of the line of place mats.

Figure 2:
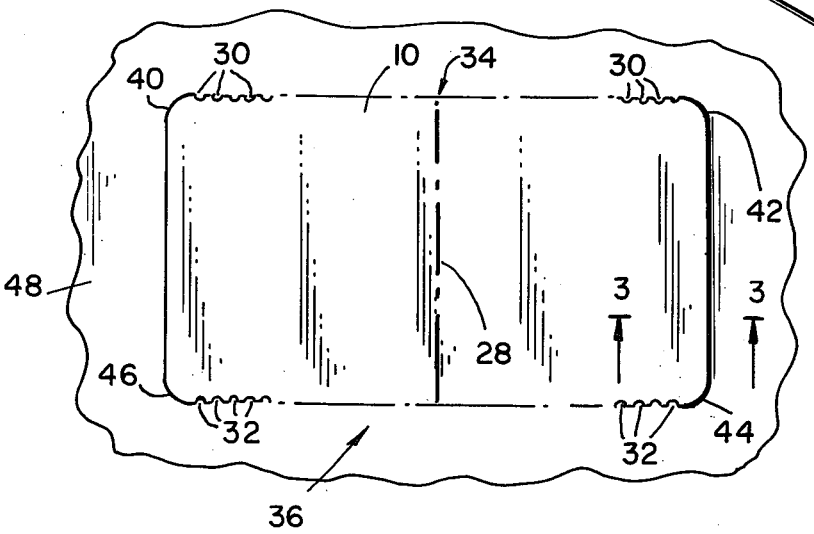
FIG. 2 is a plan view of a single non-slip place mat derived from (and detached from) the roll of FIG. 1.

Each place mat entails a generally rectangular planar flexible web, so that when each place mat, e.g. place mat 10, FIG. 2, is detached in turn from the roll 18, the detached web is indented with the typically semi-circular indents 30, 32 along the two opposed edges 34 and 36, the indents or recesses 30, 32 being derived from the respective perforations 24, 26, when the place mat 10 is detached from the adjacent place mats 14, 16. The perforations may alternatively be rectangular or oblong, or may consist of slits or slots.

Figure 3:
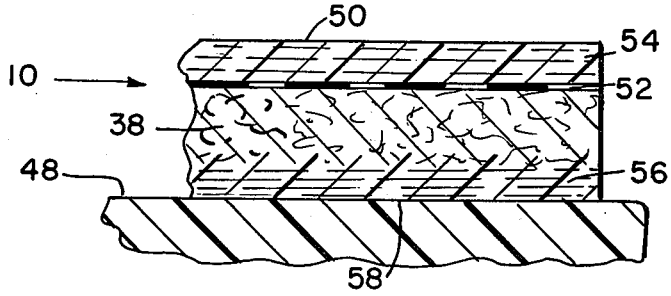
FIG. 3 is an enlarged sectional elevation view taken substantially along the line 3—3 of FIG. 2 and showing the multi-layered configuration of the place mat, and also showing the interrelationship of the various layers.

As best seen in FIG. 3, the place mat 10 is a multi-layered web; the web comprising an outer layer composition coating on both sides, this composition coating basically including a blend of water, a water-soluble salt, a wax, and a polymeric material having a molecular weight greater than the wax. The web includes a primary layer 38 of plastic, in some cases, but usually the primary layer 38 is paper or a paper base. The paper typically consists of kraft paper, cardboard, paperboard, a cellulose fiber sheet, a tissue paper structure, or parchment. When the primary layer 38 is plastic, typically the primary layer 38 is composed of polyvinyl chloride, polyvinyl acetate, polyethylene or polypropylene.

In accordance with the present invention, the four corners of each place mat web, e.g. the four corners 40, 42, 44 and 46 of place mat 10, are rounded off, so that each corner is defined by a curved periphery. The curved periphery serves to accommodate a curved or shaped tray (not shown) or other receptacle for the place mat which usually has curved corners. In the alternative, when the place mat 10 is placed on a flat surface such as surface 48 (FIG. 2), the rounded corners 40, 42, 44 and 46 with curved peripheries provide a configuration which facilitates and improves the non-slip aspect of the present place mat, by streamlining and avoiding pointed or right-angle corners.

Referring now to FIGS. 2 and 3, the place mat of the present invention 10 is placed on the surface 48. The place mat is non-slip both as to the surface 48, as well as to any objects disposed on the top 50 of the mat. The mat 10 may be conventionally printed with any desired design 52, and may be cut into the desired shape or size, preferably into the substantially rectangular shape about 9" wide by 15" long. Further, the place mat may be constructed in such a manner as to permit the printing to work in conjunction with the coating to impart more effective waterproof characteristics.

It is also envisioned, however, that printing ink pigments may be directly incorporated into the coating composition before said coating is applied to the cellulose or paper sheet. In this manner both coating and printing may be applied to the paper at the same time. Alternatively, printing ink, dyes, or colors may be directly incorporated into the paper fibers at, during, or after paper formation.

Referring now to FIG. 3, the place mat 10 is shown, comprising a cellulose fiber or paper sheet 38 upon which is applied printing 52 and a coating composition both above 54 said printing and below 56 said cellulose fibers or paper sheet. As indicated in FIG. 3, the preferred embodiment of coating composition comprises a thicker layer over the printed surface than on the non-printed surface of the cellulose sheet. It is envisioned, however, that the coating composition could be of an even thickness on both the top and bottom surfaces, for instance, when the ink pigments are directly incorporated therewith or, alternatively, in a thicker layer over the non-printed surface than over the printed surface. Never at anytime, however, need the coating be more than a fraction of an inch thick. Generally, its thickness would be only about 1 mil. or less. More specifically, approximately 3 lbs. of the composition coating would be spread evenly over 3,000 sq. ft. of paper or approximately 1.5 lbs. per side. A heavier application, so as to create a thicker coating, may also be used, if desired. When the coating composition is applied to the non-printing surface 56 it is more absorbed into the cellulose or paper fibers on the non-printed side than on the printed side.

In addition, different grades, thicknesses, and types of paper may be selected with characteristics further effecting the degree of absorption of the coating composition. The preferred weight or grade of the paper is about 30 lbs./ream; however, almost any weight paper, from about 10 to 100 lbs./ream, may be utilized effectively.

Without wishing to be bound by any theory or mechanism, it is probable that ink printed on the surface of the cellulose or paper fibers acts as a holdout, preventing absorption of the coating composition to a greater degree than on the non-printed side. Indeed, in the practice of this invention, the bottom non-printed side may only require a thinner coating due to electrostatic attraction between the place mat surface 56 and the surface 48 it rests on at level 58. Furthermore, the thicker coating on the printed side would impart stronger hydrophobic characteristics where it would be most needed.

The polymeric material of this invention and its embodiments may comprise a broad range of natural and synthetic polymers including, by way of example, acrylics, natural and synthetic latex, neoprene or any like compound. It is further within the contemplation of this invention that a combination of two or more polymers or acrylics may be used as the polymeric material. The polymeric material of this invention, when added to the water, wax and water-soluble salt may be in a solid form, a powdered solid form, dispersed in solution, dissolved in a solvent solution, or in an otherwise flowable form by the addition of heat to melting temperature, or a plasticizer known in the art. Preferably, the polymeric material is in a flowable form dissolved in the solvent solution.

It is also within the contemplation of this invention that the acrylic is an acrylic elastomer or rubber. Another preferred polymer is synthetic latex. Other useful polymers include butadiene rubber, polystyrene, and polyvinylidene chloride. A commercially available polymer preferably used with this invention is Goodrich 308 acrylic latex.

The water-soluble salt of this invention may preferably be comprised of a sodium salt such as sodium borate, otherwise known as borax. Other water-soluble salts, particularly the alkali or alkaline earth metal salts, are also within the contemplation of the invention.

The wax or paraffin of this invention may be comprised of a beeswax, a microcrystalline wax or any like wax. The ratio of water to wax to water-soluble salt of this invention is about 1:0.1 to 0.3:0.01 to 0.05, and the ratio of polymeric material to the water, wax and water-soluble salt mixture is about 1:1.

More specifically, the ratio of water to beeswax to sodium borate is preferably about 1:0.2:0.014, and the ratio of polymeric material to water, beeswax and sodium borate is about 1:1, wherein the composition coating impregnates the printed paper sheet whereby said sheet is rendered substantially hydrophobic and it and items placed on it, with the mat on a flat surface, are rendered substantially slip-resistant. The waxes useful pursuant to the present invention are those generally having a molecular weight up to about 2,000, whereas the polymeric material should have a molecular weight in excess of 2,000 and preferably in excess of 5,000. The molecular weight of the polymeric material is greater than that for the wax.

The method for preparation of the coating composition more specifically comprises heating an amount of water to at least about 80° C. and also heating an amount of wax to at least about 70° C. whereby the wax melts. The ratio of water to wax should be about 1:0.1 to 0.3 and preferably 1:0.2. A water-soluble salt is then added to the water so that the ratio of water to water-soluble salt is about 1:0.01 to 0.05 and preferably 1:0.014. The wax is then added to the water and salt mixture so that the ratio of water to wax to water-soluble salt is about 1:0.1 to 0.3:0.01 to about 0.05 and is preferably about 1:2:0.014. Finally, this mixture is added to an approximately equal amount of a polymeric material.

It is preferable that the water be heated to at least about 80° so as to facilitate dissolving a water-soluble salt, such as sodium borate, which is added to it. It is also preferable that the wax of the above method comprises a beeswax or other microcrystalline wax; however, waxes of other kinds and/or mixtures may be used. Furthermore, the wax should be heated to a temperature of at least about 70° C., so as to facilitate melting. In addition, it is preferable that the wax be added to the water and water-soluble salt mixture while continuously stirring or otherwise agitating the resultant mixture. It may also be necessary to adjust the pH of this resultant mixture in order that it may more thoroughly mix with the polymeric material. It is also within the contemplation of this invention to have a higher wax-to-water ratio (more wax per volume water) if a harder coating is desired for the place mat. The amount of water-soluble salt added would also increase proportionately with any increase in the amount of wax.

It has surprisingly been found that the place mat shape and the coating composition of this invention prevent coated place mats from sticking together when stacked on top of one another. This feature greatly facilitates both ease of storage and subsequent handling. Furthermore, the shaped place mats coated with the above coating composition are both inexpensive to produce and are extremely effective for providing a substantially hydrophobic and slippage-resistant surface. The shape and slippage-resistant surface are especially significant when the coated place mat is used on the shaped trays or tables of mass transit vehicles such as buses, boats, airplanes and trains, in addition to home use on dining room or kitchen tables, especially when children are present.

In the specification herein, there has been set forth a preferred embodiment of the invention; and although specific terms are employed, they are used in a generic and descriptive sense only and not for purposes of limitation.

Inasmuch as many changes could be made in the above constructions, and many apparently different embodiments of the invention could be made without departing from the scope thereof, it is intended that all matters contained in the above description shall be interpreted as illustrative and not in a limiting sense.

It thus will be seen that there is provided a non-slip place mat which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms and modifications of the invention, coming within the proper scope and spirit of the appended claims, will of course readily suggest themselves to those skilled in the art. Thus, while there has been described what is at present considered to be the preferred embodiment of the invention, it will be obvious to those skilled in the art that various changes and modifications may be made therein, without departing from the invention, and it is, therefore, aimed in the appended claims to cover all such changes and modifications as fall within the true spirit and scope of the invention.

What is claimed is:

1. A generally cylindrical roll of a plurality of juxtaposed non-slip place-mat articles oriented in a line, each of which comprises a generally rectangular planar flexible web, said web being multi-layered, the four corners of said web being rounded off, so that each corner is defined by a curved periphery, and said web comprising an outer layer composition coating on both sides, said composition coating comprising a blend of water, a water-soluble salt, a wax, and a polymeric material having a molecular weight greater than the wax each of said place mats being contiguously attached to adjacent place mats, in tandem, by a weakened zone comprising two associated rectilinear arrays of spaced-apart substantially circular perforations between each two adjacent place mats, each array of circular perforations extending transverse to the longitudinal axis of the line of placemats, the two associated arrays of each weakened zone extending for only a portion of the length of said weakened zone, whereby each place mat may be removed individually from said roll without causing unwanted removal of the next adjacent place mat from said roll.

2. The place mat article of claim 1 in which the indentations along two opposed edges of the web are semicircular.

3. The place mat article of claim 1 in which the web includes a primary layer of plastic or paper constituting a major part of the thickness of the web.

4. The place mat article of claim 3 in which the primary layer is composed of a plastic selected from the group consisting of polyvinyl chloride, polyvinyl acetate, polyethylene, and polypropylene.

5. The place mat article of claim 3 in which the primary layer is composed of a paper selected from the group consisting of Kraft paper, cardboard, paperboard, a cellulose fiber sheet, a tissue paper structure, and parchment.

6. The place mat of claim 1, wherein the polymeric material is one selected from the group consisting of acrylics, natural and synthetic latex, and neoprene.

7. The place mat of claim 1, wherein the polymeric material is in a powdered solid form.

8. The place mat of claim 1, wherein the polymeric material is dispersed in solution.

9. The place mat of claim 1, wherein the polymeric material is dissolved in a solvent solution.

10. The place mat of claim 1, wherein the water-soluble salt is sodium borate.

11. The place mat of claim 1, wherein the wax is comprised of one selected from the group consisting of beeswax and microcrystalline wax.

12. The place mat of claim 1, wherein the composition coating on the web is about 1 mil. thick.

13. The place mat of claim 1, wherein the place mat further comprises printing on said web.

14. The place mat of claim 13, wherein the printing is on one side of the web.

15. The place mat of claim 14, wherein the composition coating is applied over the printing and non-printing side.

16. The place mat of claim 9, wherein the ink for printing is incorporated into the composition coating.

17. The place mat of claim 1, wherein the web is dyed during the formation.

18. The place mat of claim 1, wherein the weight ratio of water to wax to water-soluble salt is about 1:0.1 to 0.3:0.01 to 0.05.

19. The place mat of claim 1, wherein the ratio of water, wax and water-soluble salt to polymeric material is about 1:1.

20. The place mat of claim 1, wherein the web is comprised of paper with a weight from about 10 to 100 lbs./ream.

21. The place mat of claim 1, wherein the polymeric material has a molecular weight of at least about 5,000.

* * * * *